United States Patent [19]

Gable, Jr.

[11] Patent Number: 4,571,353

[45] Date of Patent: Feb. 18, 1986

[54] INTERLOCKING CARPET TILE

[75] Inventor: Carl I. Gable, Jr., Atlanta, Ga.

[73] Assignee: Interface Flooring Systems, Inc., LaGrange, Ga.

[21] Appl. No.: 604,168

[22] Filed: Apr. 26, 1984

[51] Int. Cl.[4] ..... B32B 3/14

[52] U.S. Cl. ..... 428/33; 428/44; 428/82; 428/62; 428/95; 404/41; 52/590

[58] Field of Search ..... 428/33, 44, 48, 51, 428/82; 404/41; 52/590

[56] References Cited

U.S. PATENT DOCUMENTS

| | | | |
|---|---|---|---|
| 1,158,051 | 10/1915 | Hopkinson | 428/95 |
| 3,654,051 | 4/1972 | Bieler | 428/44 |
| 3,857,749 | 12/1974 | Yoshida | 428/44 |
| 4,010,301 | 3/1977 | Anderson et al. . | |
| 4,172,168 | 10/1979 | Klaffke et al. | 428/138 |
| 4,287,693 | 9/1981 | Collette | 52/177 |

FOREIGN PATENT DOCUMENTS

| | | | |
|---|---|---|---|
| 1534425 | 6/1969 | Fed. Rep. of Germany | 404/41 |
| 2401303 | 7/1975 | Fed. Rep. of Germany | 404/41 |
| 552688 | 9/1958 | Italy | 404/41 |

*Primary Examiner*—Alexander S. Thomas

*Attorney, Agent, or Firm*—Kilpatrick & Cody

[57] ABSTRACT

An improved carpet tile for commercial, industrial or home use. The carpet tile has two straight first and second edges. Its third and fourth edges each have a portion removed to form key sections at the ends and a channel indentation in the middle. The tile when installed registers diagonally with like tiles because key sections from two tiles having adjacent straight edges are received by a channel indentation of each side edge of the tile. Movement of the tile in relation to other tiles is reduced and unsightly continuous edge lines across the carpet surface are eliminated. This invention is particularly useful when applied to free-lay carpet tiles, which use no adhesive to hold them to the underlying surface, because it prevents such tiles from delaminating, curling or warping. The simple shape of the tile allows it to be manufactured and installed quickly and inexpensively.

6 Claims, 3 Drawing Figures

INTERLOCKING CARPET TILE

BACKGROUND OF THE INVENTION

This invention relates to an improved carpet tile for commercial, industrial or home use. This carpet tile interlocks with adjacent like carpet tiles to form a durable flooring surface, portions of which may be easily replaced.

Carpet tiles have become useful in covering large floor areas. Installation labor cost is saved because commercial installers are not needed to place large strips of carpet. Areas of heavy wear may be repaired simply by replacing carpet tiles rather than removing and installing whole sections of carpet. Transportation and storage of carpet tiles is easier than transportation and storage of entire rolls of carpet.

Earlier carpet tiles have utilized projections and indentations along their edges which cooperate with projections and indentations on adjacent tiles to hold the tiles in place. U.S. Pat. No. 3,857,749 issued Dec. 31, 1974 to Yoshida, for example, discloses a carpet plate comprising a processed fiber material such as cloth, felt or the like which is laminated onto a base of foamed polymer consisting mainly of ethylene. The plate has a plurality of concavities and convexities on all of its side surfaces. These concavities and convexities fit with the concavities and convexities of adjoining plates fo form a floor covering. These plates require a fairly intricate cutting process to form the relatively large number of concavities and convexities on all sides, and this relatively large number of projections on these plates provides a greater likelihood that portions of the carpet tiles will curl or delaminate.

Another form of carpet tile is disclosed in U.S. Pat. No. 3,654,051, issued Apr. 4, 1972 to Bieler. These tiles have complex complementary irregularities along all edges to insure a homogeneous appearance with concealed edges when installed. Because of the shape of these irregularities, these tiles may be oriented in only one direction with respect to other such tiles.

Other floor covering tiles having irregular sides which cooperate with one another are disclosed in U.S. Pat. No. 4,287,693 issued Sept. 8, 1981 to Collette, U.S. Pat. No. 4,172,168 issued Oct. 23, 1979 to Klaffke, et al., and U.S. Pat. No. 1,158,051 issued Oct. 26, 1915 to Hopkinson. The projections of the tiles of these patents have acute angles which will provide inadequate support for face yarn at the acute corners or edges of the tiles, and thereby fail to retain such face yarn and contribute to curling or warping of such projections or edges.

SUMMARY OF THE INVENTION

The carpet tiles of this invention have two straight top and bottom edges and two side edges with a simple indentation to receive portions of the sides of two adjacent tiles. The tiles are installed in a staggered interlocking relationship so that they register diagonally with one another. The simple side edges and the straight top edges allow the tiles to be cut in a continuous process and more quickly and inexpensively than tiles having more complex projections on all four sides.

The interlocking feature of carpet tiles of the present invention is advantageous because it permits a tight and quick installation of tile by untrained installers. Experienced installers typically install conventional carpet tile by first installing a row of tiles across the middle of a room floor and then installing a column of tiles also crossing the middle of the floor to form a cross dividing the room into four quarters. The remaining tiles are then filled into the four smaller areas. Even a slight misalignment of tiles at one side of a room will result in a substantial gap at the other side of the room. The interlocking tiles of the present invention, however, tend to align themselves with one another so that such gaps into which dirt or other foreign objects can fall or become lodged are prevented or decreased.

Carpet tiles may have an adhesive layer covered with a protective sheet which is removed prior to installation. They may be bonded to the underlying surface by means of a mastic or adhesive, or they may be substantial enough to stay in place when positioned without the need for any adhesive. The latter type of tiles are known as "free-lay" carpet tiles. In interlocking free-lay carpet tiles, it is important that any projections or irregularities along the sides of the carpet do not curl or warp, particularly under concentrated stress, to form dangerous obstacles and unsightly irregularities in the surface covering provided by the tiles. The absence of projections having acute angles or a high aspect ratio (length as compared to width) prevents curling and warping, allows the pile surface to be adequately supported on all portions of the tile, and reduces delamination of layers in the projections.

It is therefore an object of this invention to provide a carpet tile which may be manufactured and installed inexpensively, and which cooperates with adjacent carpet tiles in an interlocking relationship.

It is a further object of this invention to provide a carpet tile having cooperating projections on only two sides of the tile.

It is also an object of this invention to provide a carpet tile having projections with low aspect ratios so that the face yarn of the tile is adequately supported and no obstructions result when the tile is placed in use.

An additional object of this invention is to provide a carpet tile having projections with low aspect ratios to reduce curling, warping and delamination.

It is yet another object of this invention to provide free-lay carpet tiles which may be easily placed and which register diagonally when in place.

Other objects, features and advantages of this invention will become apparent in the descriptions and claims below.

DETAILED DESCRIPTION OF THE INVENTION

Figure 1:
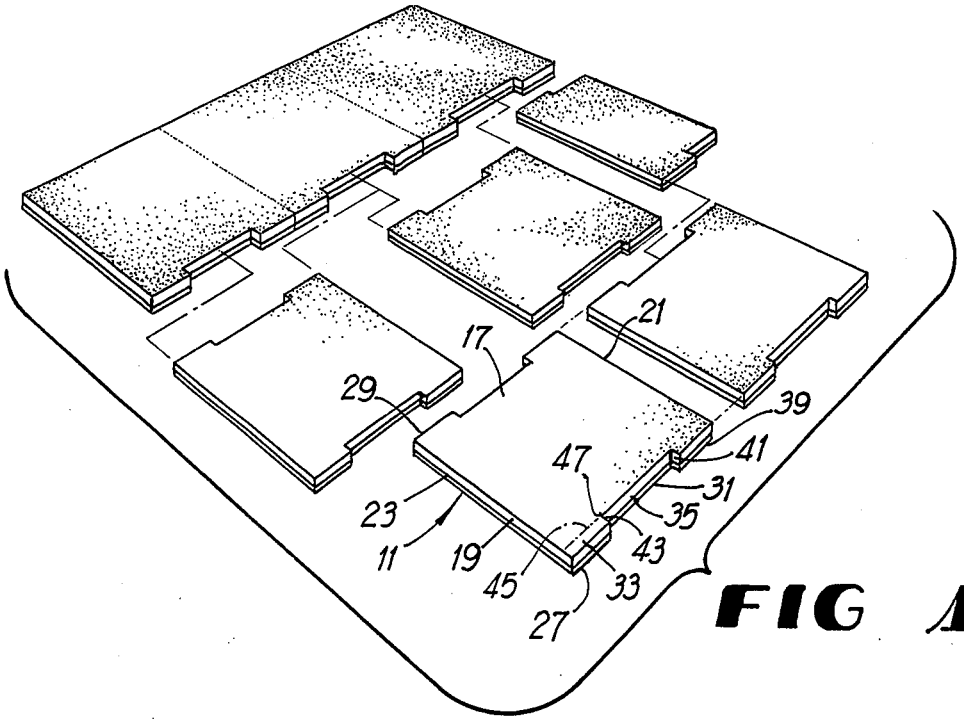
FIG. 1 is an exploded perspective view showing the interlocking relationship of an embodiment of carpet tiles of this invention.

FIG. 1 shows one embodiment of carpet tiles 11 of the present invention in an exploded perspective view. Each carpet tile 11 has a bottom surface 13, a top surface 17 and a plurality of side surfaces 19. Two of the side surfaces of carpet tile 11 are straight edges, first straight edge 21 and second straight edge 23. The other two side surfaces 19, third edge 27 and fourth edge 29, are straight edges having a section or channel section 31 cut from them. After the channel section 31 is cut from third edge 27 or fourth edge 29, two key sections 33 and a channel 35 are left to form these edges. Each key section 33 is defined by a key leading edge 39 and a key side edge 41. The channel 37 is defined by two key side edges 41 and a channel inner edge 43. Key side edges 41 may be straight or curved.

In all cases, the aspect ratio of a key section 33 is less than one. As shown in FIG. 1, the aspect ratio of a key section 33 is the ratio of its length 40 to its width 42. Conceptually, the key section 33 is wider than the length that it projects from tile 11, and thus resists any tendency to curl, warp or delaminate. In the tiles 11 of FIG. 1, length 40 is the length of key side edge 41, and width 42 is the length of key leading edge 39 of each key section 33. Where tiles 11 have curved key side edges 41, the length 40 of a key section 33 is the distance along its corresponding first straight edge 21 or second straight edge 23 from its key leading edge 39 to a line (the "base line" 45) perpendicular to first straight edge 21 and intersecting the point on key side edge 41 closest to key leading edge 39 at which key side edge 41 is perpendicular to straight edge 21 (the "zero point" 47). Width 42 of such a key section 33 is the length of base line 45.

Figure 2:
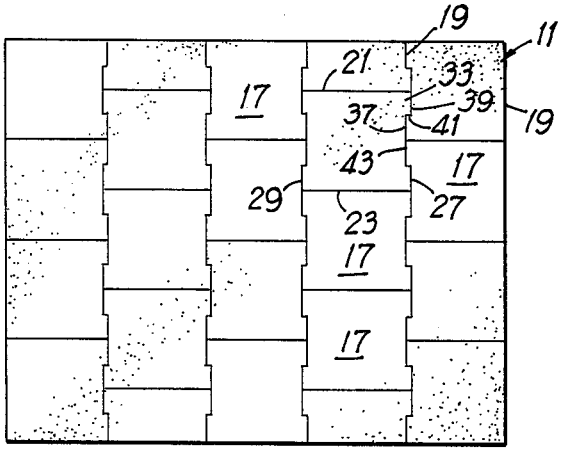
FIG. 2 is a plan schematic view showing tiles of FIG. 1 in place.

FIG. 1 clearly shows the relationships between key sections 33 of carpet tiles 11 and channels 37 of adjacent carpet tiles 11. Channels 37 define an area equal to the area of two key sections 33, and a key leading edge 39 and a key side edge 41 of a key section 33 conform to and cooperate with a key side edge 41 and one-half of a channel inner edge 43 defining one-half of a channel 37. Thus, a key section 33 on each of two adjacent carpet tiles 11 fits into the channel 37 of a third adjacent carpet tile 11. In this manner, each carpet tile "is interlocked" with another carpet tile 11 both laterally and longitudinally. No straight tile edges continuously traverse a carpet made of such carpet tiles 11, because tiles 11 register diagonally with one another and because of the formed shapes of third edges 27 and fourth edges 29. This registration is shown in FIG. 2.

Because the carpet tiles 11 of the present invention have no projecting portions with an aspect ratio greater than 1, carpet tiles 11 support more adequately the face yarn or pile 47 of carpet tiles 11. Because the aspect ratios of key sections 33 are less than 1, these key sections 33 are wider than the length that they protrude from carpet tiles 11. As a result, no long protrusions of laminated layers extend from carpet tiles 11 which may later delaminate under stress for lack of adequate surrounding material. Furthermore, any tendency of key sections 33 to curl or warp upward so as to form an obstruction on the carpet surface is reduced, because of the relatively great width and small length of key sections 33. Finally, key sections 33 have no acute angles, or angles smaller than 90 degrees, which would cause pointed projections from carpet tiles 11 which may easily delaminate, curl or warp.

The features of carpet tiles 11 of the present invention are particularly useful where carpet tiles 11 are free-lay carpet tiles. Free-lay carpet tiles are carpet tiles that are not adhesively joined to the supporting surface. One problem encountered with free-lay tiles is their propensity to buckle, curl or warp after a certain period of use. The addition of projections from such tiles only increases this tendency. The low aspect ratio of the projecting key sections 33 of carpet tiles 11, however, minimizes any curling or warping of key sections 33.

Figure 3:
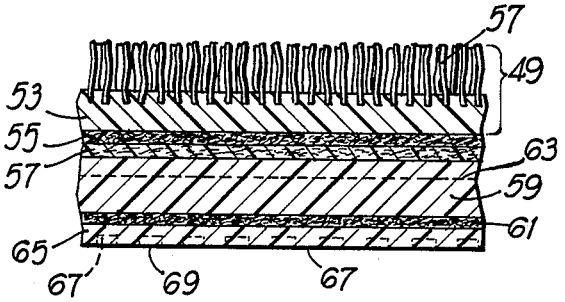
FIG. 3 is a side sectional view of one of the tiles of FIG. 1.

The low aspect ratio also decreases delamination of key sections 33, particularly in free-lay carpet tiles. Free-lay carpet tiles typically have several layers or laminations to stiffen and stabilize the tiles and to give them proper cushioning and flexibility properties. Such tiles are disclosed in U.S. Pat. No. 4,010,301 issued Mar. 1, 1977 to Anderson, et al., which patent is incorporated herein by this reference. Tiles 11 of the preferred embodiment, for instance, as shown in cross-section in FIG. 3, have a facing portion 49 comprising yarns or pile 51 partially imbedded in an upper layer of resilient thermoplastic material 53. These thermoplastic materials may include elastomeric materials such as natural or synthetic rubbers, polychloroprene, acrylonitrile-butadiene copolymers, ethylene-propylene-diene rubbers, petroleum resins, vinyl polymers, polybutene resins, polyisobutene-butadiene resins and copolymers, mixtures thereof, and the like. Preferred resilient thermoplastic materials include vinyl polymers such as polyvinyl chloride, polyvinylidine chloride, polyvinyl acetate, polyvinyl acetal, polyvinyl butyral, and copolymers or mixtures or any of these vinyl polymers.

Beneath and joined to the upper layer of resilient thermoplastic material 53 of tiles 11 of the preferred embodiment is a first stiffening layer of glass fibers or other material 55. These fibers may be woven or nonwoven. This first stiffening layer 55 imparts stiffness to carpet tiles 11. Beneath and joining first stiffening layer of glass fibers 55 is an intermediate layer of polyester and glass fibers 57. Suitable polyesters for this layer include polyethylyne terephthalate, polybutylene, terephthalate polycyclohexane-(1,4)-dimethylol terephthalate and the like. Immediately below intermediate layer 57 is a middle layer of resilient thermoplastic material 59. This thermoplastic material may be composed of any of the materials or vinyl polymers stated above in connection with upper layer of resilient thermoplastic material 53. Immediately below and joining middle layer of resilient thermoplastic material 59 is a second stiffening layer of glass fibers 61 which imparts significant dimensional stability and resistance to curling or warping of carpet tiles 11. This stiffening layer 61 is below the bending axis 63 of carpet tile 11 and therefore cooperates with first stiffening layer 55 which is above bending axis 63, to prevent such curling or warping. Finally, a bottom layer of thermoplastic material 65 is added, which may be composed of the materials identified above in connection with upper layer of resilient thermoplastic material 53. Bottom layer 65 may have indentations or other designs 67 on its bottom surface 69 to cooperate with the underlying floor or other surface to increase the coefficient of friction between tiles 11 and the floor and prevent tiles 11 from sliding.

The layers of glass fibers, polyester and glass fibers and resilient thermoplastic materials in carpet tiles 11 may be rearranged in relation to one another and increased or decreased in thickness to provide greater density to carpet tiles 11, to make carpet tiles 11 stiffer or not as stiff, to increase the flexibility or cushioning effect of carpet tiles 11, or for other purposes. Some of these layers may be deleted, and others may be added. In any event, carpet tiles 11 comprise a number of laminated layers and therefore have the potential to delaminate after wear and exposure. The low aspect ratio of key sections 33 of carpet tiles 11 of the present invention therefore take on even more significance in light of this highly laminated structure because they help prevent such delamination.

In use, carpet tiles 11 are placed so that key sections 33 fit into channels 37 of adjacent carpet tiles 11. Key sections 33 on one edge of a carpet tile 11 fit into two different channels 37 of two different carpet tiles 11. Similarly, a channel 37 receives key sections 33 from two different adjoining carpet tiles 11. The key side edges 41 of each carpet tile 11 prevent carpet tiles 11 adjoining third and fourth edges 27 and 29 from sliding in relation to that carpet tile 11, and stability of the carpet surface is thereby increased. When a particular portion of the carpet surface becomes worn, carpet tiles 11 may be simply lifted out of place and replaced with new carpet tiles 11.

The foregoing description of the present invention is for purposes of explanation and illustration. It will be apparent to those skilled in the relevant art that modifications and changes may be made to the invention as thus described without departing from its scope and spirit.

I claim:

1. A free-lay carpet tile comprising:
(a) an upper pile surface;
(b) a lower surface;
(c) a first stiffening layer;
(d) first and second parallel straight edges; and
(e) a third and a fourth edge, each comprising:
(i) two key sections, each located adjacent to each of the first and second straight edges, and each having:
(x) a key leading edge; and
(y) a key side edge forming an angle with the key leading edge of at least ninety degrees; and
(z) an aspect ratio of less than one; and
(ii) a channel section for receiving key sections from two adjacent like carpet tiles, of an area equal to the area of two key sections, and defined by:
(x) a channel inner edge; and
(y) two key side edges.

2. A carpet tile according to claim 1 wherein the distance between said first and second straight edges is equal to the length of the first straight edge.

3. A carpet tile according to claim 1 further comprising a second stiffening layer, and at least one layer of thermoplastic material.

4. A carpet tile according to claim 1 further comprising a backing layer with friction-increasing means to increase the friction between the carpet tile and the underlying surface.

5. A free-lay carpet tile comprising:
(a) an upper pile surface;
(b) at least one stiffening layer of glass fibers;
(c) at least one layer of resilient thermoplastic material;
(d) first and second parallel straight edges; and
(e) a third and a fourth edge, each comprising:
(i) two key sections, each located adjacent to each of the first and second straight edges, and each having:
(x) a key leading edge; and
(y) a key side edge; and
(ii) a channel section for receiving key sections from two adjacent like carpet tiles, of an area equal to the area of two key sections, and defined by:
(x) a channel inner edge; and
(y) two key side edges;
the distance between said first and second straight edges being equal to the length of the first straight edge, and the aspect ratio of each key section being less than one.

6. A free-lay carpet tile comprising:
(a) a facing comprising carpet pile fabric partially imbedded in an upper layer of resilient thermoplastic material;
(b) a first stiffening layer of glass fibers joined to the upper layer of resilient thermoplastic material;
(c) an intermediate layer of polyester and glass fibers joined to the first stiffening layer;
(d) a middle layer of thermoplastic material joined to the intermediate layer of polyester and glass fibers;
(e) a backing joined to the middle layer of thermoplastic material comprising:
(i) a second stiffening layer of glass fibers joined to the middle layer of thermoplastic material; and
(ii) a bottom layer of thermoplastic material joined to the second stiffening layer;
(f) first and second parallel straight edges;
(g) a third and a fourth edge, each comprising:
(i) two key sections, each located adjacent to each of the first and second straight edges, and each having:
(x) a key leading edge; and
(y) a key side edge; and
(ii) a channel section for receiving key sections from two adjacent like carpet tiles, of an area equal to the area of two key sections, and defined by:
(x) a channel inner edge; and
(y) two key side edges;
the distance between said first and second straight edges being equal to the length of the first straight edge, and the aspect ratio of each key section being less than one.

* * * * *